US006390042B1

(12) United States Patent
Scott et al.

(10) Patent No.: US 6,390,042 B1
(45) Date of Patent: May 21, 2002

(54) SELF-SEALING RELEASABLE AND REUSABLE PLUG

(75) Inventors: Matthew T Scott, Henrietta; Timothy M Nieves, Geneseo; Dominic Borraccia, Spencerport; Jason M Urckfitz, Brockport; Daniel Richard Cuatt, Henrietta, all of NY (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 09/565,966

(22) Filed: May 5, 2000

(51) Int. Cl.[7] ..... B65D 51/16; F01L 1/344

(52) U.S. Cl. ..... 123/90.17; 220/DIG. 19; 277/616; 277/628; 74/568 R

(58) Field of Search ..... 220/787, 790, 220/DIG. 19, 215, 355, 364; 138/89.1, 89.3, 89.4, 90; 277/616, 626, 628, 631, 907; 123/90.17, 90.31; 74/568 R

(56) References Cited

U.S. PATENT DOCUMENTS 1,800,173 A * 4/1931 Anderson ..... 126/319
4,334,632 A * 6/1982 Watanabe ..... 220/787
4,363,240 A * 12/1982 Mizusaki ..... 116/227
4,953,742 A * 9/1990 Kraus ..... 220/367.1
5,505,324 A * 4/1996 Danico ..... 220/201
5,540,197 A * 7/1996 Golovatai-Schmidt et al. ..... 123/90.17
6,319,436 B1 * 11/2001 Jaeger et al. ..... 264/255

* cited by examiner

*Primary Examiner*—Anthony Knight
*Assistant Examiner*—E Peavey
(74) *Attorney, Agent, or Firm*—John VanOphem

(57) ABSTRACT

An improved releasable and reusable self-sealing plug for mechanically sealing a bore. A cylindrical body is formed on its outer surface to retain radial sealing means such as an O-ring. An oversize annular cap at the outer end of the body limits ingress of the plug into a bore, and a pair of opposed, flexible limbs terminating in flanges beyond the inner end of the body are compressed radially during insertion of the plug and spring out at completion of insertion to grip the inner entrance to the bore, thus holding the O-ring and plug in the bore. Insertion may be accomplished manually without the aid of tools. The plug cannot be driven out by pressure on the bore, but is easily removed by recompression of the limbs and flanges and withdrawal of the plug by, for example, needle-nose pliers. The plug may be formed inexpensively and easily by injection molding of a suitable plastic polymer.

8 Claims, 4 Drawing Sheets

SELF-SEALING RELEASABLE AND REUSABLE PLUG

TECHNICAL FIELD

The present invention relates to a blind plug for closing an opening; more particularly, to a plug for sealingly closing an end of a cylindrical bore without use of threaded means; and most particularly, to a formed plastic plug which may be sealingly inserted into a bore without use of tools, which cannot be forced out by differential pressure across the plug, and which can be removed without impairing the sealing properties of the plug, such that the plug can be reused.

BACKGROUND OF THE INVENTION

Plugs for sealingly closing openings such as bores are well known. A common configuration of a sealing plug has a threaded shank formatably engaging with threads in the bore to draw the plug into the bore, and a cap at the end of the shank having a greater diameter than the bore for forming a seal against a surface surrounding the bore when urged against this surface by action of the threads.

Such a plug has at least three disadvantages. First, both the plug and the bore must be threaded, which can add to the difficulty and cost of manufacture. Second, the plug typically requires a tool, for example, a screwdriver or Allen wrench, for both insertion and removal. Third, a threaded seal is vulnerable to becoming unthreaded and thus developing a leak, particularly when used axially on an object which is subject to sudden, repeated, and extreme changes in rate of rotation about its axis, for example, an automotive cam shaft phaser such as is disclosed in U.S. Pat. No. 5,540,197 issued Jul. 30, 1996 to Golovatai-Schmidt et al., the relevant disclosure of which is hereby incorporated by reference.

Plugs for smooth bores are also known. Typically, such a plug has a close fitting shank which occupies the bore in an almost interference fit, an oversized cap for limiting ingress into the bore, and a flexible latching means at the inner end for engaging the inner end of the bore. There are two serious shortcomings of this type of plug. First, the seal is not a true bore seal but also depends typically upon having the latching means urge the cap against the surface surrounding the outer end of the bore with a force sufficient to prevent leakage between the cap and the surface. Thus internal pressure under the plug must raise the plug only a very small distance to create a leak. Second, removal of the plug requires inserting a screwdriver or other prying tool under the edge of the cap. This action can readily damage the plug such that it cannot be reused.

It is a principal object of the invention to provide an improved plug which may be inserted manually into a bore to form a seal with the wall of the bore.

It is a further object of the invention to provide an improved plug which may be readily removed from a bore without requiring special tools and without impairing the future sealing capability of the plug.

It is a still further object of the invention to provide an improved plug which may be formed inexpensively, as by molding from a plastic polymer. It is a still further object of the invention to provide an improved plug which cannot be loosened by axial rotation.

It is a still further object of the invention to provide an improved plug which cannot be forced out of a bore by pressure differential across the plug.

SUMMARY OF THE INVENTION

Briefly described, an improved releasable, reusable, self-sealing plug for sealing a bore in accordance with the invention has a cylindrical body, formed on its outer surface to retain sealing means, such as an O-ring, for sealing against the wall of the bore. An oversize annular cap at the outer end limits ingress of the plug into a bore, and a pair of opposed, flexible flanges at the inner end are compressed during insertion and spring out at completion of insertion to grip the inner entrance to the bore, thus holding the plug in the bore. The plug cannot be driven out by pressure in the bore, but is easily removed by recompression of the flanges and withdrawal by, for example, needle-nose pliers. Such recompression and withdrawal does not impair the sealing capability of the plug, so that the plug may be reused repeatedly if so desired. The plug may be easily and inexpensively formed by injection molding of a suitable polymer.

BRIEF DESCRIPTION OF THE DRAWINGS

The foregoing and other objects, features, and advantages of the invention, as well as presently preferred embodiments thereof, will become more apparent from a reading of the following description in connection with the accompanying drawings in which.

DESCRIPTION OF THE PREFERRED EMBODIMENT

The improvements and benefits conferred by a plug in accordance with the invention may be best understood by first considering a prior art plug.

Figure 1:
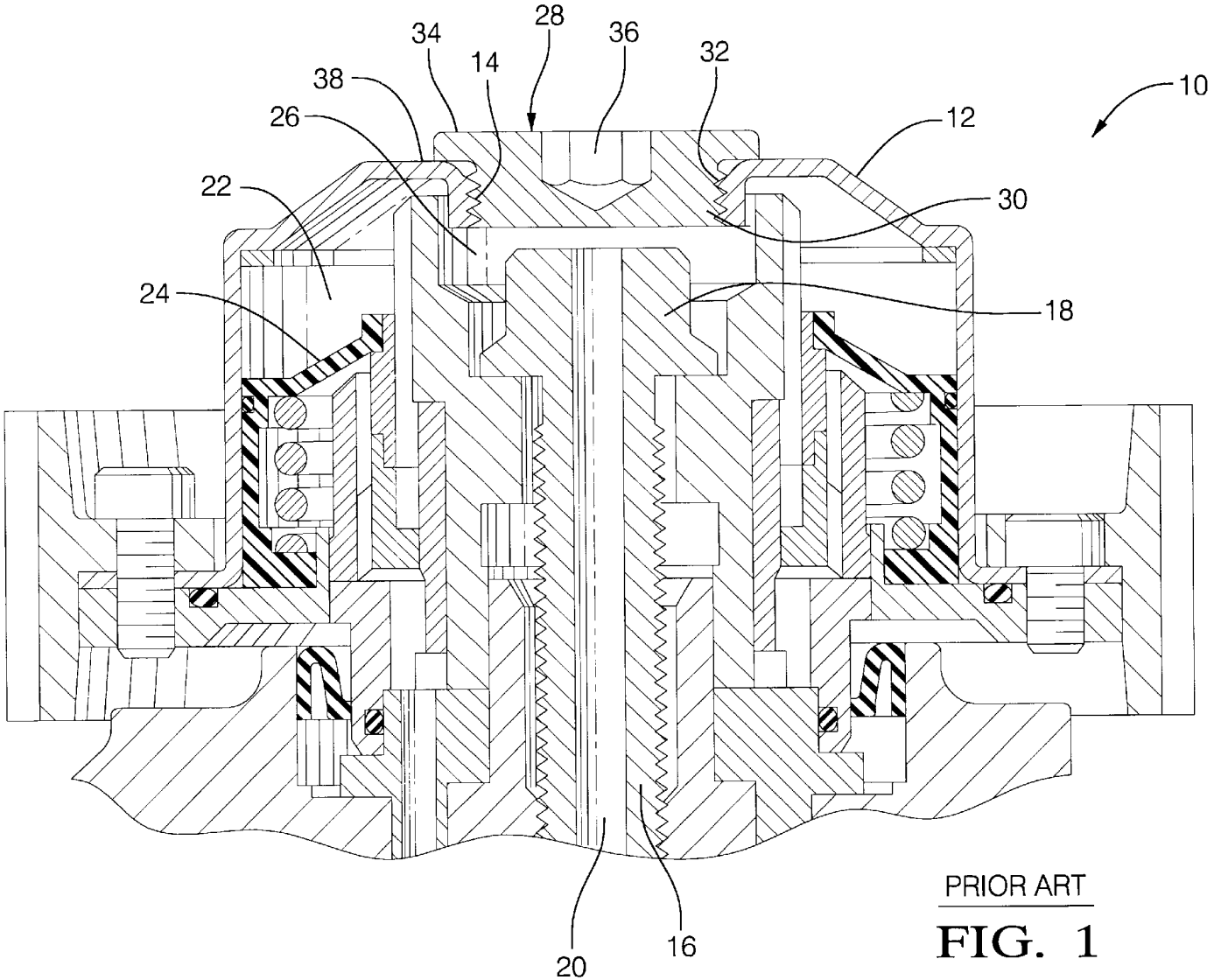
PRIOR ART FIG. 1
FIG. 1 is an elevational cross-sectional view of a prior art threaded plug, shown in use as a cover plug in a known automotive camshaft phaser.
Figure 2:
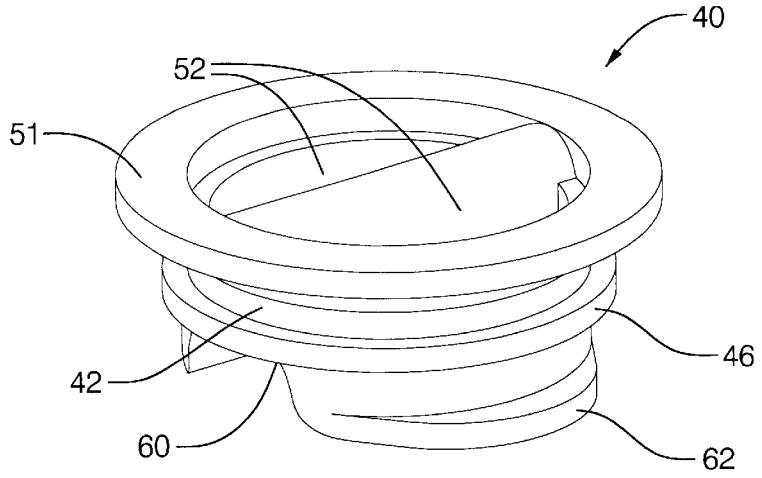
FIG. 2 is an isometric view of a self-sealing, removable, reusable plug, shown as molded and without the addition of a sealing O-ring.
Figure 3:
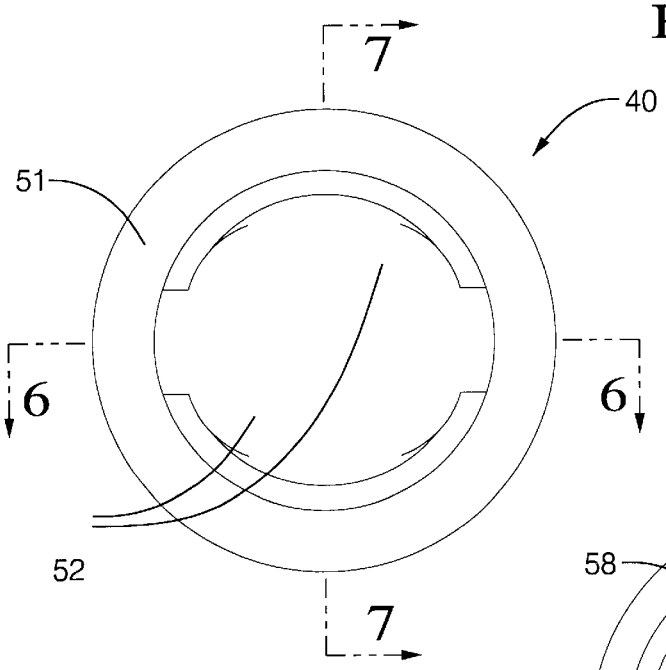
FIG. 3 is a plan view of the plug shown in FIG. 2.

Referring to FIG. 1, numeral 10 generally indicates an automotive camshaft phaser substantially identical with the phaser disclosed in U.S. Pat. No. 5,540,197 (incorporated by reference hereinabove) as FIG. 1. The construction and operation of such a cam phaser is well known and is fully disclosed in the reference. Of relevance to the present invention is cover 12 which has a cylindrical return flange defining a central bore 14 to allow insertion of bolt 16 to secure the phaser to the camshaft (not shown). Bolt 16 and bolt head 18 have a central bore 20 to permit pressurized oil to flow, as programmed, from source (not shown) to an actuating chamber 22 above phase control piston 24. Thus the intermediate chamber 26 around bolt head 18 is part of the oil flow path, which is closed by plug 28. Prior art plug 28 includes a cylindrical shank 30, having threads 32 on its circumferential surface, and a head portion 34 having a diameter greater than the diameter of bore 14 so that when plug 28 is tightened in place, as by insertion of an Allen wrench into hexagonal socket 36, an axial seal is formed between head 34 and the axial surface 38 of cover 12.

Figure 4:
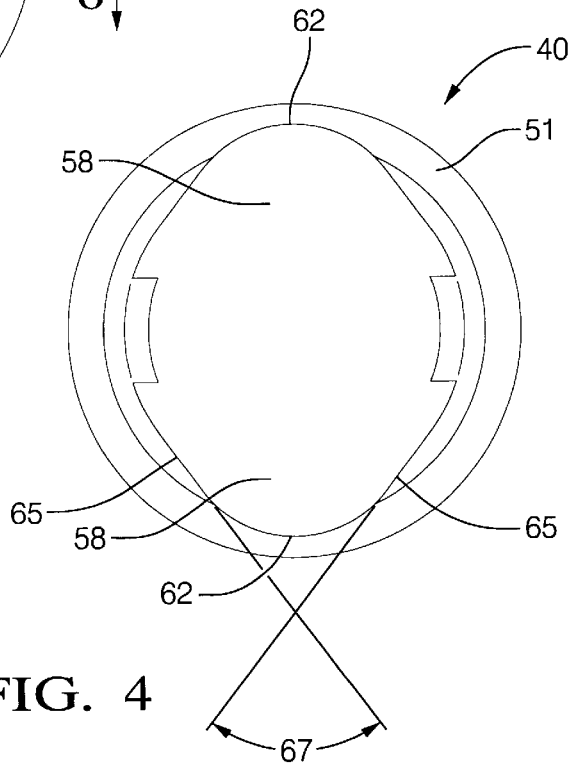
FIG. 4 is a bottom view of the plug shown in FIG. 2.
Figure 5:
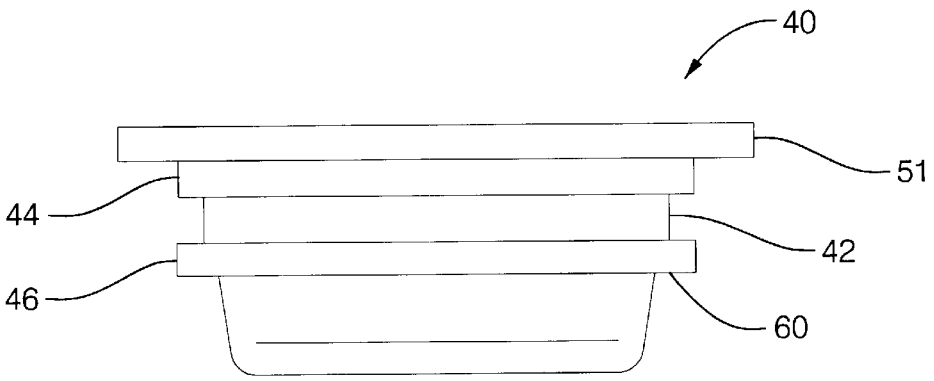
FIG. 5 is a side view of the plug shown in FIG. 2.
Figure 6:
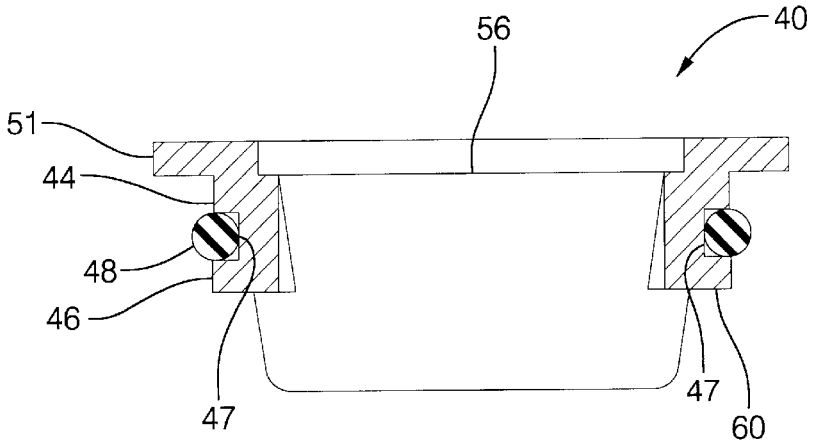
FIG. 6 is a first cross-sectional view of the plug shown in FIG. 2, taken along line 6—6 in FIG. 3, showing an O-ring installed on the radial surface of the plug body.
Figure 7:
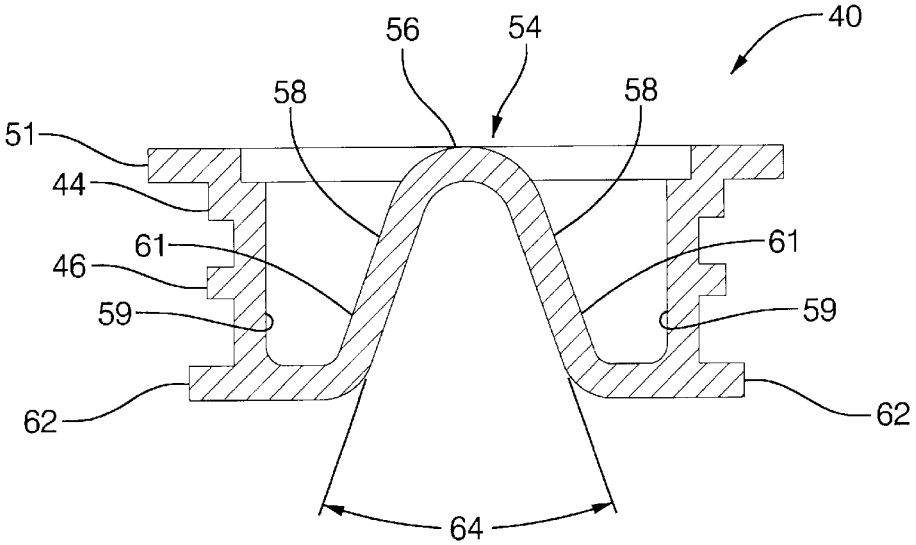
FIG. 7 is a second cross-sectional view of the plug shown in FIG. 2, taken along line 7—7 in FIG. 3.
Figure 8:
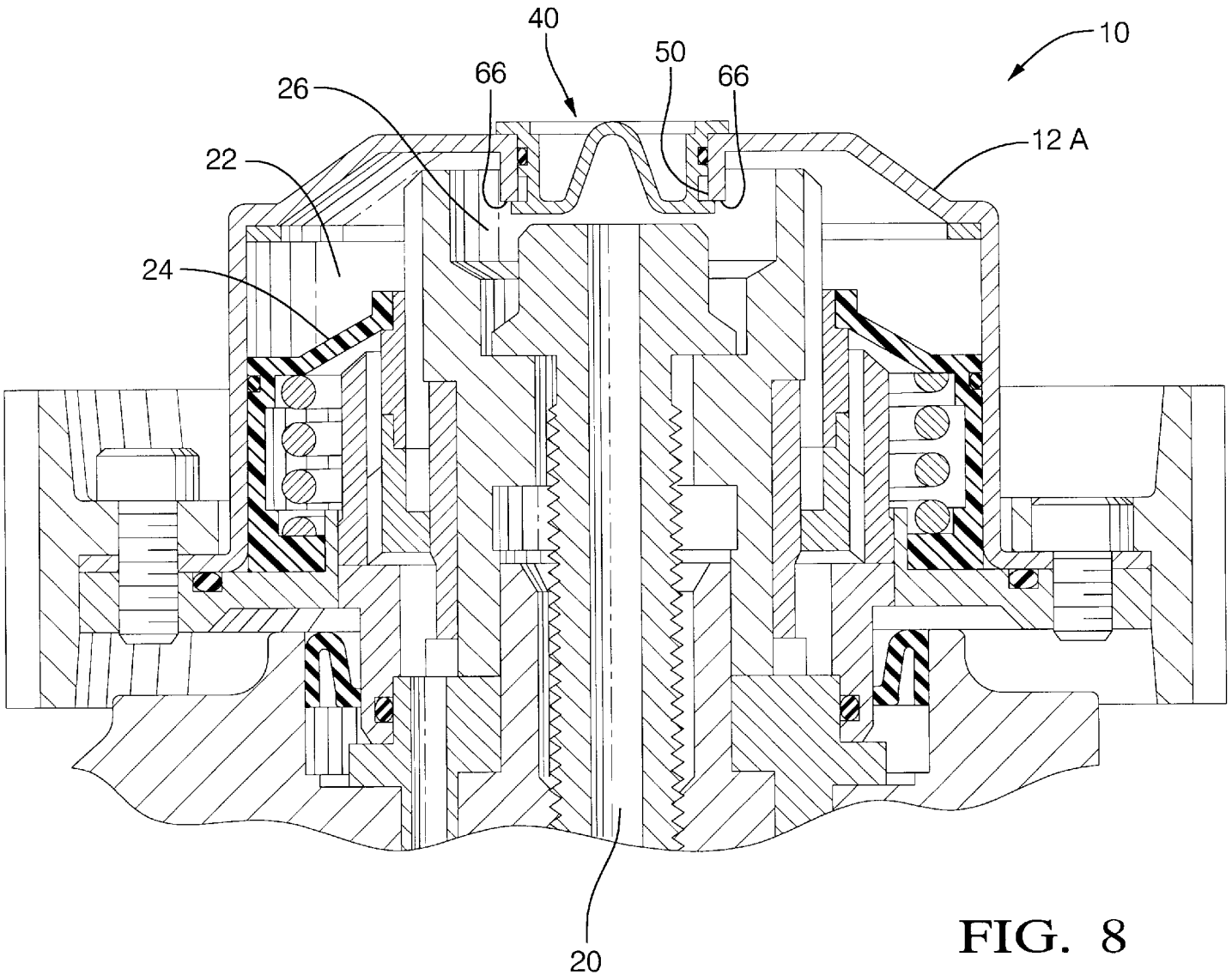
FIG. 8 is an elevational cross-sectional view like that shown in FIG. 1, showing the camshaft phaser cover adapted with a smooth bore central opening for receiving the improved plug shown in FIG. 2, in accordance with the invention.

Referring to FIGS. 2 through 8, a plug 40 in accordance with the invention comprises a generally cylindrical longitudinal body 42 having on the outer surface thereof a pair of axially spaced-apart circumferential ribs 44,46 defining therebetween a groove 47 for retaining an O-ring 48 for forming a radial seal between the plug and a smooth bore 50 into which the plug may be inserted, for example, a smooth bore in a modified cover 12*a* of a cam phaser 10, as shown in FIG. 8. The outer end of the body terminates in an annular cap 51 having a larger outer diameter than the diameter of the bore 50 for limiting ingress of the plug into the bore. Within a bifurcated central recess 52 in the cap and body and integral with the body is a formed element 54 having a general "tent" shape, as shown especially in FIG. 7; specifically, an outer ridge 56 spanning the opening in the annular cap, and first and second identical divergent flexible limbs 58 formed by the joining of outer recess walls 59 and inner recess walls 61 extending from the ridge beyond the end 60 of the body opposite the cap, each limb terminating in radial flange 62, the diameter between the outer edges of the flanges being greater than the bore to be plugged. The limbs diverge at a predetermined included angle 64, preferably about 40°. Especially note, the limbs are connected by a continuous web, like a diaphragm, with the cap and body such that the plug is impermeable and imperforate. Preferably, each limb 58 tapers such that the edges 65 of the limb converge to describe an apparent included angle 67 of, preferably, about 68°, as shown in FIG. 4.

Preferably, the distance between the underside of the annular cap and the upper side of the flanges is the same as, or slightly greater than, the axial length of the bore. Thus, when the plug is inserted into the bore, until restrained from further ingress by the cap, the O-ring and the flexible flanges are compressed during passage through the bore, and the flanges then spring out at the terminus of the bore 66 to hold the plug in the bore, the O-ring forming a static radial seal against the wall of the bore. Unlike prior art plug 28, plug 40 forms a seal with the wall of the bore by radial compression of the O-ring and does not require axial force of the plug to effect a seal. In this sense, the plug is said to be self-sealing.

The plug may be installed manually by simply pressing it into the bore, without use of any tools. Pressure against the inside of the installed plug serves only to drive the limbs and flanges outwards, and thus the plug cannot be dislodged by such pressure, nor can it be loosened or dislodged by relative rotation between the plug and bore. Further, because the seal is radial instead of axial as in the prior art, slight axial movement of the plug in the bore is of no consequence.

Removal of plug 40 from bore 50 is effected simply with the aid of pliers, such as needle-nose pliers or similar compressing tool. Engaging opposite jaws of pliers (not shown) in recess 52 against the outer surfaces of limbs 58 and squeezing to reduce angle 64 withdraws flanges 62 radially from engagement with terminus 66, allowing plug 40 to be withdrawn axially from the bore. Such action does not permanently deform the sealing surface of body 42 or O-ring 48, and thus plug 40 may be reused with no impairment in sealing capability.

Plug 40 is easily formed by injection molding of a suitable thermoplastic polymer, for example, glass-filled nylon, in known fashion.

From the foregoing description, it will be apparent that there has been provided an improved self-sealing, releasable, reusable plug. Variations and modifications of the herein described plug, in accordance with the invention, will undoubtedly suggest themselves to those skilled in this art. Accordingly, the foregoing description should be taken as illustrative and not in a limiting sense.

What is claimed is:

1. A self-sealing, releasable, and reusable plug for closing an open bore through an object, comprising:

a) a longitudinal body having means for retaining sealing means on a radial surface thereof;

b) sealing means disposed on said radial surface;

c) an annular cap disposed at a first end of said body and having an outer diameter greater than the diameter of the bore to be closed and having a bifurcated central recess extending through said cap into said body, said recess having outer and inner walls, the inner walls diverging to join said outer walls thereby defining first and second opposed and divergent limbs extending beyond a second end of said body; and d) a radially extending flange at a free end of each limb, the distance between opposed outer tips of the flanges being greater than the diameter of the bore to be closed.

2. A plug in accordance with claim 1 wherein said body is generally cylindrical.

3. A plug in accordance with claim 1 wherein said sealing means includes an O-ring having a non-compressed outer diameter greater than the diameter of the bore to be closed.

4. A plug in accordance with claim 2 wherein said means for retaining comprises an annular groove in said cylindrical body.

5. A plug in accordance with claim 4 wherein said groove is defined by a pair of spaced-apart annular circumferential ribs on said radial body surface.

6. A plug in accordance with claim 4 wherein an O-ring having a non-compressed outer diameter greater than the diameter of the bore to be closed is disposed within said annular groove.

7. A plug in accordance with claim 1 wherein said limbs are radially flexible.

8. A camshaft phaser, comprising:

a cover having an open bore, said open bore having a bore diameter; and a plug removably disposed in said open bore, said plug comprising:

a) a longitudinal body having a radial surface, a first end, and a second end, said radial surface having retaining means disposed thereon;

b) sealing means disposed on said radial surface of said longitudinal body, said sealing means being retained by said retaining means;

c) an annular cap disposed at said first end of said body, said annular cap having an outer cap diameter, said outer cap diameter being a predetermined amount larger than said bore diameter, said annular cap having a bifurcated central recess extending through said cap into said body, said recess having outer and inner walls, said inner walls diverging radially outward thereby defining first and second opposed and divergent limbs, said limbs extending radially outside of said outer walls and being disposed adjacent to said second end of said body, each of said limbs having a free end; and d) a radially extending flange disposed on each said free end of each of said limbs, each said radially extending flange having a respective outer tip, each said outer tip being disposed radially outside of said open bore.

* * * * *